United States Patent [19]

Bennett

[11] 4,301,821

[45] Nov. 24, 1981

[54] NAIL CARE CAROUSEL

[76] Inventor: Robert A. Bennett, 170 Sturbridge Rd., Easton, Conn. 06425

[21] Appl. No.: 141,153

[22] Filed: Apr. 17, 1980

[51] Int. Cl.[3] ..... A45D 29/04

[52] U.S. Cl. ..... 132/75.6

[58] Field of Search ..... 132/75.6, 73–75, 132/79, 88.5, 88.7

[56] References Cited

U.S. PATENT DOCUMENTS

| | | | |
|---|---|---|---|
| 1,351,364 | 8/1920 | Booty | 132/75.6 |
| 2,593,896 | 4/1952 | Kollontag | 132/79 R |
| 2,655,288 | 10/1953 | Caretto | 132/79 R |

*Primary Examiner*—G. E. McNeill

[57] ABSTRACT

A device for use in manicuring employs a vertical member and a plurality of vertical elements disposed side by side. Each element is secured to said member by a corresponding living hinge. Each element has vertically upright and vertically inverted positions. Each element has a recess which points downward when the element is upright and which points upward when the element is inverted. The device also employs a like plurality of elongated manicuring implements, each implement having a head detachably engaging a corresponding recess in a corresponding element. Each implement extends downward when its corresponding element is upright and extends upward when its corresponding element is inverted. The member has a circumference which defines a regular polygon, the number of sides of the polygon being equal to said plurality. Each of said elements is connected by its corresponding living hinge to the corresponding side. A flexible hollow elongated vertical tube has a closed top end secured to said member and an open bottom end. An additional manicuring implement is removably disposed in the tube, a portion of the additional implement extending downwardly below the bottom end.

7 Claims, 9 Drawing Figures

NAIL CARE CAROUSEL

BACKGROUND OF THE INVENTION

Individuals normally use a plurality of individual implements such as nail files, emery boards, cuticle scissors and the like in cleaning, cutting and shaping finger nails. These implements when not in use are often stored in a drawer, cabinet or the like and become misplaced or are carried in a fitted case. The cases have specially shaped loops and the like which often tear or become loose whereby implements can fall out.

The present invention is directed toward a device which contains all the implements needed in manicures. The implements are stored in the device when not in use and can be individually utilized in caring for nails as desired without being removed from the device. Thus, the implements cannot fall out or become individually misplaced.

SUMMARY OF THE INVENTION

In accordance with the principles of the invention, a device for use in manicuring comprises a vertical member and a plurality of vertical elements disposed side by side. Each element is secured to said member by a corresponding living hinge, whereby the element can have vertically upright and vertically inverted positions. Each element has a recess which points downward when the element is upright and which points upward when the element is inverted.

A like plurality of elongated manicuring implements such as nail files, emery boards and the like are employed. Each implement has a head detachably engaging a corresponding recess in a corresponding element, each implement extending downward when its corresponding element is upright and extending upward when its corresponding element is inverted.

The member can have a circumference which defines a regular polygon, the number of sides of the polygon being equal to said plurality. Each of said elements is connected by its corresponding living hinge to the corresponding side.

A flexible hollow elongated vertical tube having a closed top end and a open bottom end is secured at its top end to the member. An additional manicuring implement such as a scissors or nail clip is removably disposed in the tube. A portion of the additional implement extends downwardly below the bottom end.

A hollow body is also used. This body has the shape of a hollow vertical truncated cone with a relatively large open bottom end and a relatively small top end. The small end has an opening defining a like polygon. This opening is larger than the polygon defined by the member circumference. The member and tube are slidably engagable with and disengagable from said body. The member when so engaged is centered within said opening in a manner at which each peripheral side of the opening bears against the adjacent element when inverted to lock same into position.

The open end of the tube can be flush with the bottom end of the body when the member and tube engage said body.

A flat horizontal circular disc has a central opening secured along its periphery to the bottom end of the tube. The diameter of the disc is slightly larger than the diameter of the bottom end of the body.

When the member and tube fully engage the body and the elements are all in the upright position, the device is easily carried in a pocket or stored out of the way. The implements are hidden and are not visible. The additional implement such as a scissors or nail clip can be easily pulled downwardly out of the tube and through the opening of the disc for use and then can be subsequently replaced.

In order to use any of the implements secured in the elements, the body is pulled away from the member and tube. The selected element is inverted whereby the desired element extends outwardly in opposite direction from the other implements so secured. The body is then replaced, and the selected element is locked in position between the member and the periphery of the opening in the small top end of the body. The other elements are hidden within the body and the user holding the body as a handle can manipulate the selected implement as desired.

DETAILED DESCRIPTION OF PREFERRED EMBODIMENTS

Referring now to FIGS. 1–9, a hollow vertical member has a small vertical top shank 10 which in cross section defines a regular hexagon whereby the shank has six vertical flat sides. A flat horizontal sheet is secured at its center to the bottom of the shank. The circumference of the sheet defines a larger hexagon, each edge of which is parallel to a corresponding side of the shank.

Figure 6:
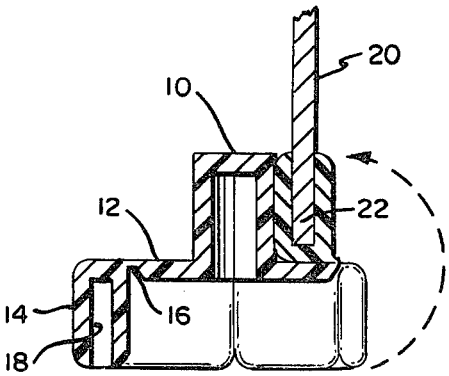
FIG. 6 is a view similar to FIG. 5 but showing the member in position for use.

A separate rectangular element 14 is secured to each edge of the sheet by a corresponding living hinge 16. When the element is in upright position shown in FIG. 5, it depends downward from the edge and contains a downwardly pointing recess 18. When the element is inverted, as shown in FIG. 6, the element bears against the corresponding vertical surface of the shank and the recess points upward. Thus there are six elements.

Six elongated manicuring implements 20 such as nail files or emery boards are used, each having a head 22 which fits tightly but removably in a corresponding recess 18 whereby each implement points downward when the corresponding element is upright and points upward when the corresponding element is inverted.

A hollow flexible elongated vertical tube 24 has an upright tip 40 at its top end which fits into the hollow interior of shank 10, the tube extending downward to a bottom open end. A flat horizontal disc 26 has a central opening 28 which is secured along its periphery to the bottom open end of tube 24.

Figure 2:
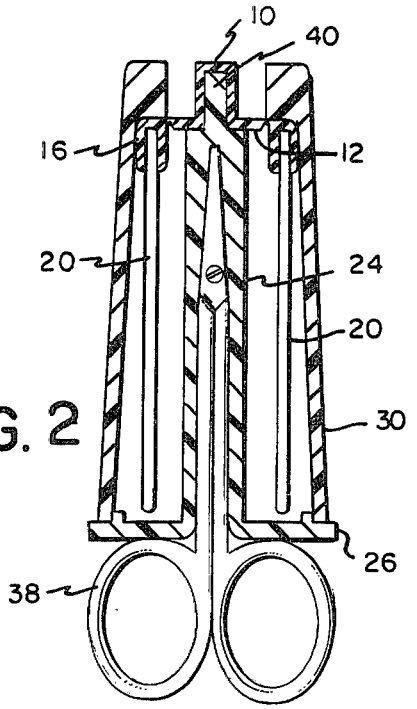
FIG. 2 is a vertical cross section of the invention with all implements stored therein.
Figure 1:
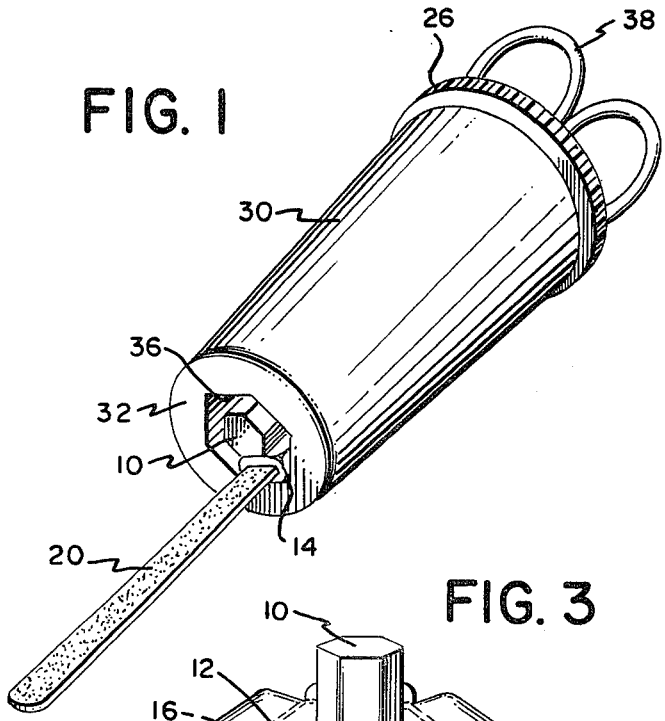
FIG. 1 is a perspective view of the invention with an emery board extended ready for use.
Figure 3:
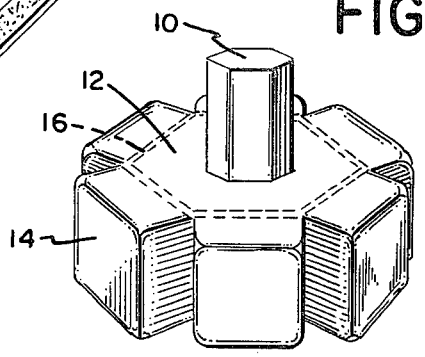
FIG. 3 is a detail view of a member used in the invention.
Figure 4:
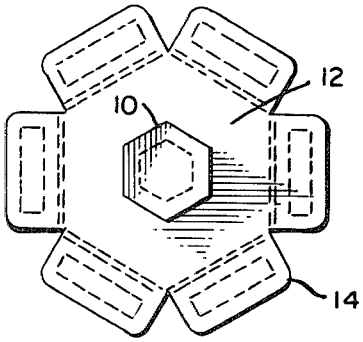
FIG. 4 is a top view of the member of FIG. 3.
Figure 5:
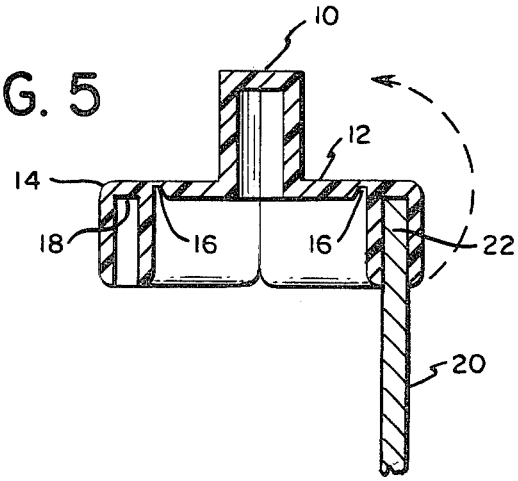
FIG. 5 is a detail cross section of the member with one implement in stored position.
Figure 7:
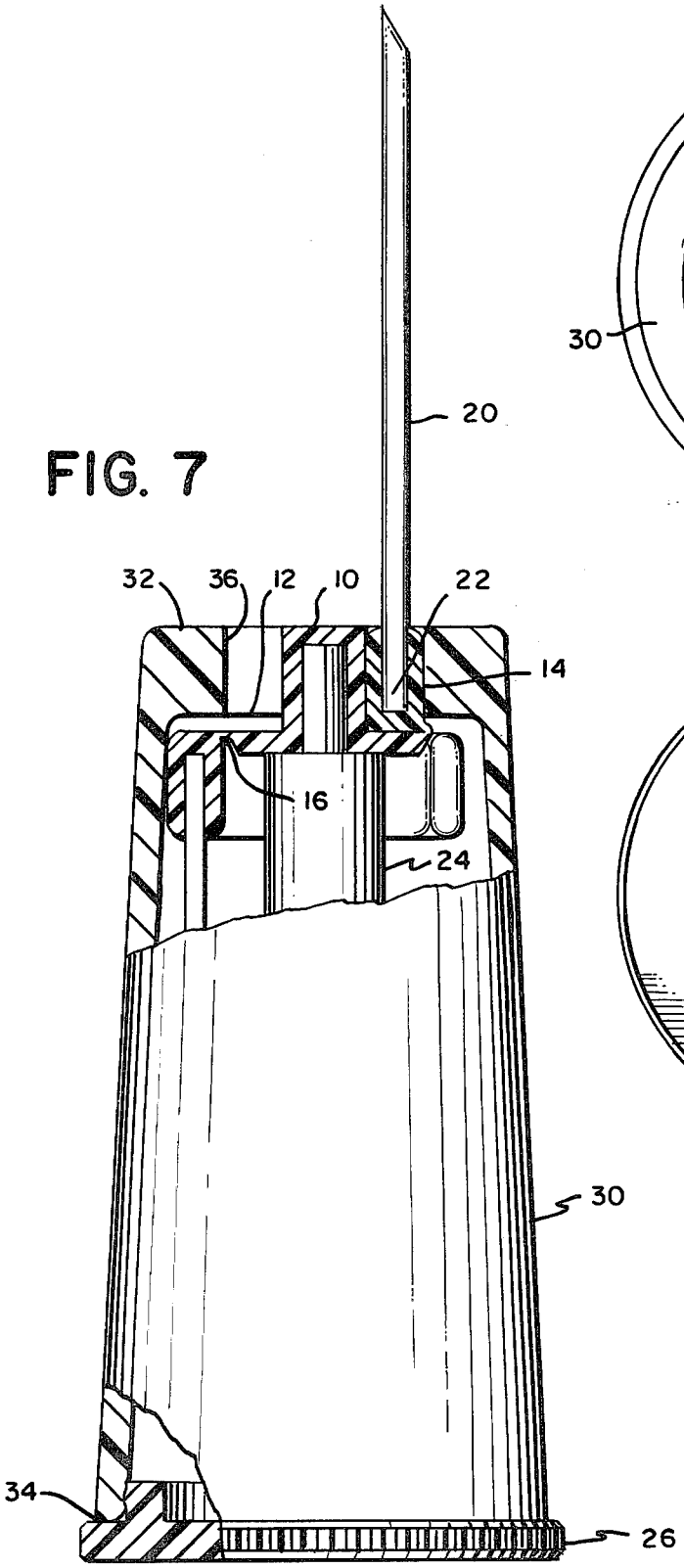
FIG. 7 is a partially cut away side view of the invention shown in FIG. 1.
Figure 8:
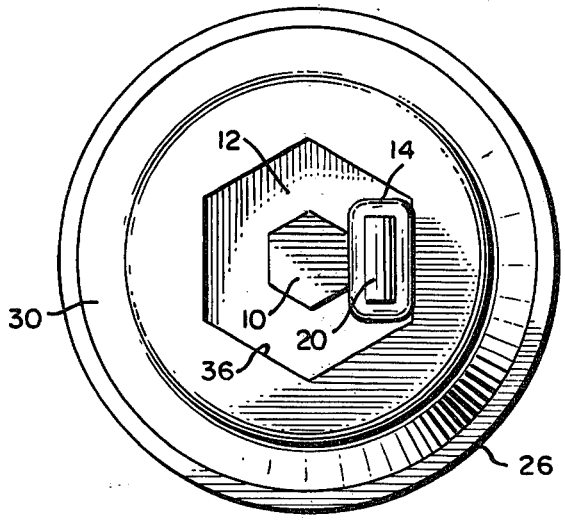
FIG. 8 is a top view of the structure shown in FIG. 7.
Figure 9:
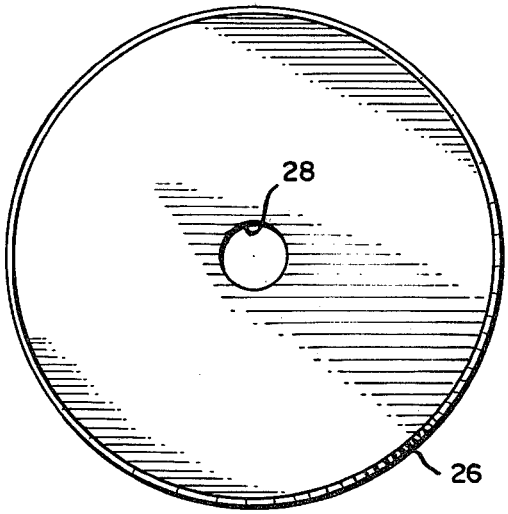
FIG. 9 is a bottom plan view of a disc used in the invention.

A hollow body defines a truncated hollow cone 30 with a smaller top end 32 and a larger open bottom end 34. End 32 has an opening 36 defining a hexagon, each side of opening 36 being parallel to a corresponding vertical surface of the shank. This body can be slid over the member and elements to engage disc 26 thereby concealing all elements as shown in FIG. 2. The body can be removed, one element inverted and then the body can be slid over the elements and member with a selected implement extended for use as shown in FIG. 1 and FIG. 7.

In this case, the element containing the extended implement is locked in position between the corresponding vertical surface of the shank and the corresponding edge of opening 36.

A scissors 38, nail clip or the like can be removably disposed in the tube with a portion of such implement extending below the disc for ease of removal or replacement.

What is claimed is:

1. A device for use in manicuring, said device comprising:

a vertical member;

a plurality of vertical elements disposed side by side, each element being secured to said member by a corresponding living hinge, each element having vertically upright and vertically inverted positions, each element having a recess which points downward when the element is upright and which points upward when the element is inverted; and a like plurality of elongated manicuring implements, each implement having a head detachably engaging a corresponding recess in a corresponding element, each implement extending downward when its corresponding element is upright and extending upward when its corresponding element is inverted.

2. The device of claim 1 wherein said member has a circumference which defines a regular polygon, the number of sides of the polygon being equal to said plurality, each of said elements being connected by its corresponding living hinge to the corresponding side.

3. The device of claim 2 wherein the member includes a vertical shank which in horizontal cross section defines a like but smaller polygon and also includes a flat horizontal sheet secured its center to the bottom of the shank, said sheet having said circumference, each hinge being secured to a corresponding edge of said sheet, each edge of the sheet being parallel to a corresponding vertical side of the shank, each element when inverted bearing against a corresponding vertical side of the shank.

4. The device of claim 3 further including a flexible hollow elongated vertical tube having a closed top end secured to said member and an open bottom end and an additional manicuring implement removably disposed in the tube, a portion of the additional implement extending downwardly below the bottom end.

5. The device of claim 4 further including a hollow body having the shape of a hollow vertical truncated cone with a relatively large open bottom end and a relatively small top end having an opening defining a like polygon, said opening being larger than the polygon defined by the member circumference, said member and tube being slidably engagable with and disengagable from said body, said member when so engaged being centered within said opening in a manner at which each peripheral side of the opening bears against the adjacent element when inverted to lock same into position.

6. The device of claim 5 wherein the open end of the tube is flush with the bottom end of the body when the member and tube engage said body.

7. The device of claim 6 further including a flat horizontal circular disc having a central opening secured along its periphery to the bottom end of the tube, the diameter of the disc being slightly larger than the diameter of the bottom end of the body.

* * * * *